US005588543A

United States Patent [19]

Finger

[11] Patent Number: 5,588,543

[45] Date of Patent: Dec. 31, 1996

[54] ADJUSTABLE SHELVING SYSTEM

[75] Inventor: Gary E. Finger, Voorhees, N.J.

[73] Assignee: Artcraft Wire Works, Inc., Pennsauken, N.J.

[21] Appl. No.: 232,670

[22] Filed: Apr. 25, 1994

[51] Int. Cl.[6] ..... A47F 5/00

[52] U.S. Cl. ..... 211/90; 211/88; 211/106; 211/119; D6/525

[58] Field of Search ..... 211/89, 90, 106, 211/113, 118, 119, 181, 88, 87; D6/566, 567, 569

[56] References Cited

U.S. PATENT DOCUMENTS

| | | | |
|---|---|---|---|
| D. 293,183 | 12/1987 | Aaron | D6/525 |
| D. 315,840 | 4/1991 | Emery | D6/525 |
| D. 341,283 | 11/1993 | Rosenthal | D6/566 |
| 2,195,919 | 4/1940 | Crilly et al. | 211/106 X |
| 2,678,184 | 5/1954 | Erdody | 248/311 |
| 3,181,702 | 5/1965 | Raphael | 211/119 |
| 3,295,471 | 1/1967 | Cook | 211/106 X |
| 3,391,891 | 7/1968 | Garden | 211/181 X |
| 3,659,722 | 5/1972 | Carroll | 211/106 |
| 3,680,712 | 8/1972 | Jurasek | 211/181 |
| 3,789,996 | 2/1974 | Stroh | 211/119 |
| 3,915,097 | 10/1975 | Young, Jr. | 108/6 |
| 4,106,736 | 8/1978 | Becker, III et al. | 211/106 X |
| 4,343,405 | 8/1982 | Virte et al. | 211/119 |
| 4,697,712 | 10/1987 | Valiulis | 211/187 |
| 5,014,860 | 5/1991 | Emery | 211/106 |

*Primary Examiner*—Robert W. Gibson, Jr.
*Attorney, Agent, or Firm*—Norman E. Lehrer; Jeffrey S. Ginsberg

[57] ABSTRACT

An adjustable shelving system for use as a shower caddy or the like includes a frame and a plurality of shelves. The frame has a number of spaced apart vertical bars and a number of spaced apart horizontal bars extending across said vertical bars. The shelves each have a back edge and a bracket affixed thereto which can be readily detached from the frame of the shower caddy and placed at a number of different locations on the frame. The bracket has an upper connecting element extending rearwardly from the back of the shelf. The upper connecting element engages a horizontal bar of the frame located behind the back of the shelf. The bracket also includes a lower connecting element extending downwardly from the upper connecting element. The lower connecting element engages the bottom of one of the horizontal bars located below the back edge of the shelf and creates a friction fit.

13 Claims, 3 Drawing Sheets

ADJUSTABLE SHELVING SYSTEM

BACKGROUND OF THE INVENTION

This invention relates to an adjustable shelving system, and more particularly, to an adjustable shelving system comprising a frame equipped with shelves that can be secured to the frame in substantially any position. The frame has particular use as a shower caddy. However, it should be understood that the frame and attached shelves can be utilized for a variety of other uses. For example, it can be used to support kitchen items, such as spice containers, utensils and dish towels.

It is desirable to have an assortment of bathing items readily accessible when taking a shower. Numerous article supporting devices, commonly called shower caddies, have been developed to support such items so that a person taking a shower can grasp the items without having to bend down or otherwise exert him or herself.

A problem with known article support devices lies in the way the shelves are attached to the frame of the shower caddy. Some shelves, for example, are not firmly attached to the frame. In U.S. Pat. No. 4,106,736, a shelf is attached to a standard by means of a bracket which secures the top part of the shelf to the frame. However, the shelf can be detached from the frame by applying a small amount of upward force on the bottom of the frame resulting in the supported items falling to the ground.

U.S. Pat. No. 3,295,471 shows a shelf connected to a frame by having an upper end portion looped around the frame. The bottom portion of the shelf is free to move. Such movement would cause the articles being supported to fall over. See, also, U.S. Pat. Nos. 3,680,712 and 2,678,184.

Other shelves are not readily detachable from the frame. For example, U.S. Pat. No. 3,789,996 shows a shelf fixture for attachment to a shower head that includes a number of shelves that are welded to the frame. Therefore, the shelves are not detachable and can not be placed on different locations on the frame. U.S. Pat. No. Des. 315,840 and U.S. Pat. No. 3,295,471 are similarly limited.

U.S. Pat. No. Des. 293,183 shows a shower caddy that has shelves that can be removed from the frame, however the arrangement of the shelves can not be changed. Therefore, larger items, such as shampoo bottles, placed on the lower shelf will not be able stand upright if the distance between the upper shelf and lower shelf is less than the height of the item.

Accordingly, there is a need for a shower caddy that has shelves that can be readily removed from a frame and can be securely reattached in substantially any order. In addition, there is a need for a shower caddy that can support both large and small bathing items.

SUMMARY OF THE INVENTION

The invention in the present application is an adjustable shelving system comprising a frame having shelves that can be easily removed from the frame and fixedly reattached in substantially any position so that differently sized and shaped items can be supported.

In accordance with the illustrative embodiments, demonstrating features and advantages of the present invention, there is provided a frame having a number of spaced apart vertical bars and a number of spaced apart horizontal bars extending across the vertical bars. A bracket connected to a shelf allows the shelf to be mounted on the frame. The bracket has an upper connecting means extending upwardly and rearwardly from the back edge of the shelf. The upper connecting means is engagable with the horizontal bar located above the back edge of the shelf. The bracket includes a lower connecting means extending downwardly and rearwardly from the back edge of said shelf. The lower connecting means is engagable with the horizontal bar located below the back edge of the shelf.

Each shelf has its own corresponding bracket. The brackets enable the shelves to be firmly secured to substantially any area on the frame. The shelves can be arranged to ensure that the bathroom items can be conveniently reached by the person taking a shower. Furthermore, the shelves can be slightly offset horizontally on the frame so that bigger items can be placed upright without interfering with the shelf immediately above. Therefore, the present invention makes it possible to support numerous bathroom items of varying sizes.

BRIEF DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

DETAILED DESCRIPTION OF THE PREFERRED EMBODIMENTS

Figure 1:
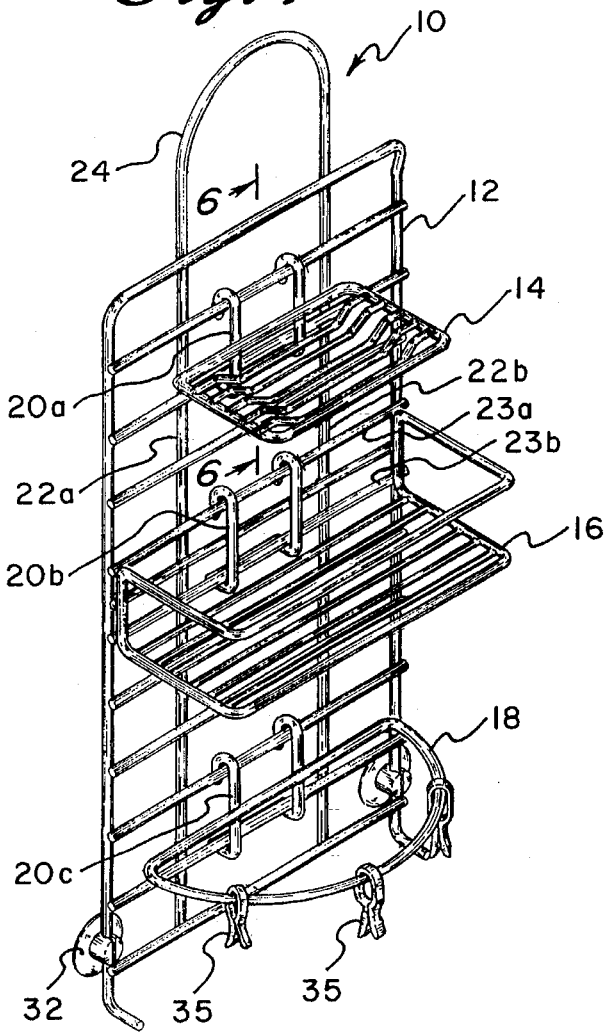
FIG. 1 is a left, front perspective view of an adjustable shelving system in the form of a shower caddy.
Figure 2:
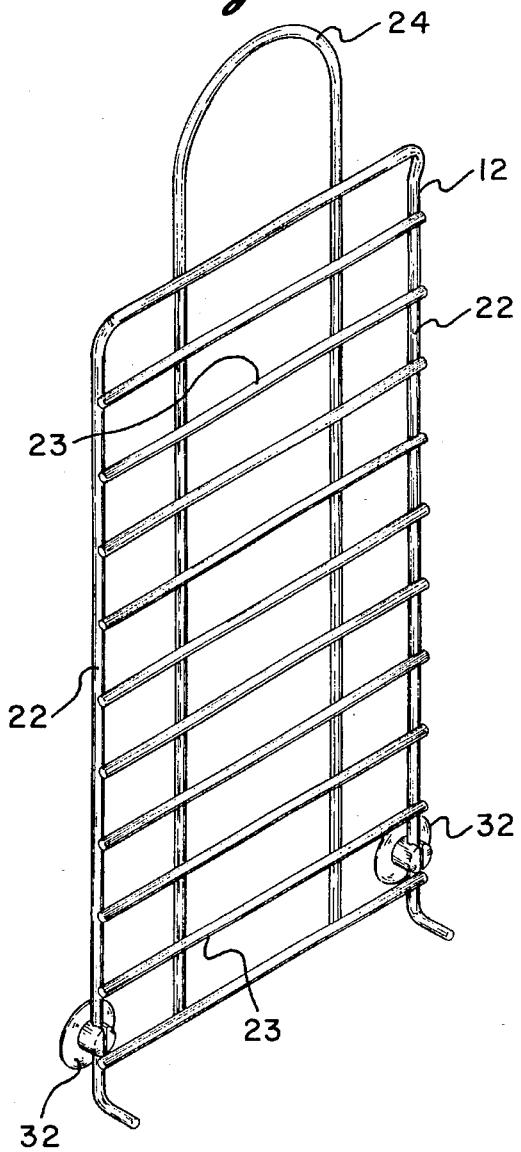
FIG. 2 is a left, front perspective view of the frame portion of the shower caddy.
Figure 3:
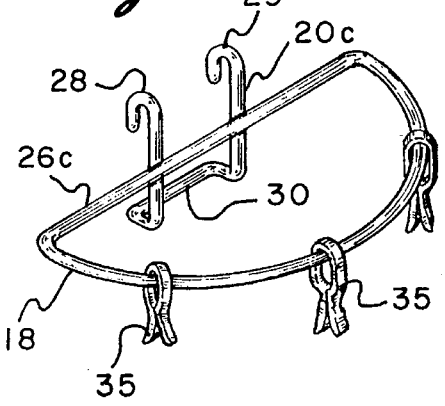
FIG. 3 is a perspective view of a shelf with an attached bracket and a number of holding clips.
Figure 4:
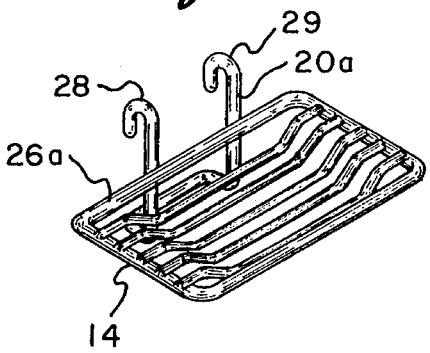
FIG. 4 is a perspective view of a soap shelf with an attached bracket.

Referring now to the drawings in detail wherein like reference numerals have been used throughout the various figures to designate like elements, there is shown in the figures an adjustable shelving system in the form of a shower caddy constructed in accordance with the principles of the present invention and designated generally as 10. The shower caddy 10 is comprised of a frame 12 and shelves 14, 16, and 18. Each shelf is mounted to the frame 12 by a corresponding bracket 20*a*, 20*b* and 20*c*.

The frame 12 has a plurality of spaced apart vertical bars 22 and a plurality of spaced apart horizontal bars 23 extending across vertical bars 22. The horizontal and vertical bars are preferably made of uniform cross-sectional material such as metal wire and are covered with a plastic coating. A pair of adjacent vertical bars 22*a* and 22*b* converge at their tops to form U-shaped segment 24. U-shaped segment 24 may be placed around a shower head (not shown) from which the shower caddy is suspended.

The shower caddy of the present invention includes shelves 14, 16 and 18 for holding various items that are commonly used by a person taking a shower. In the preferred embodiment, shelf 14 is sized to support a bar of soap, shelf 16 is sized to support larger items, such as shampoo bottles (not shown), and shelf 18 is a drying ring. A plurality of clips 35 can be mounted on drying ring 18 for grasping a variety of articles, such as a face cloth. It should be readily apparent, however, that the foregoing is by way of example only and a variety of different types and numbers of shelves can be utilized.

Figure 5:
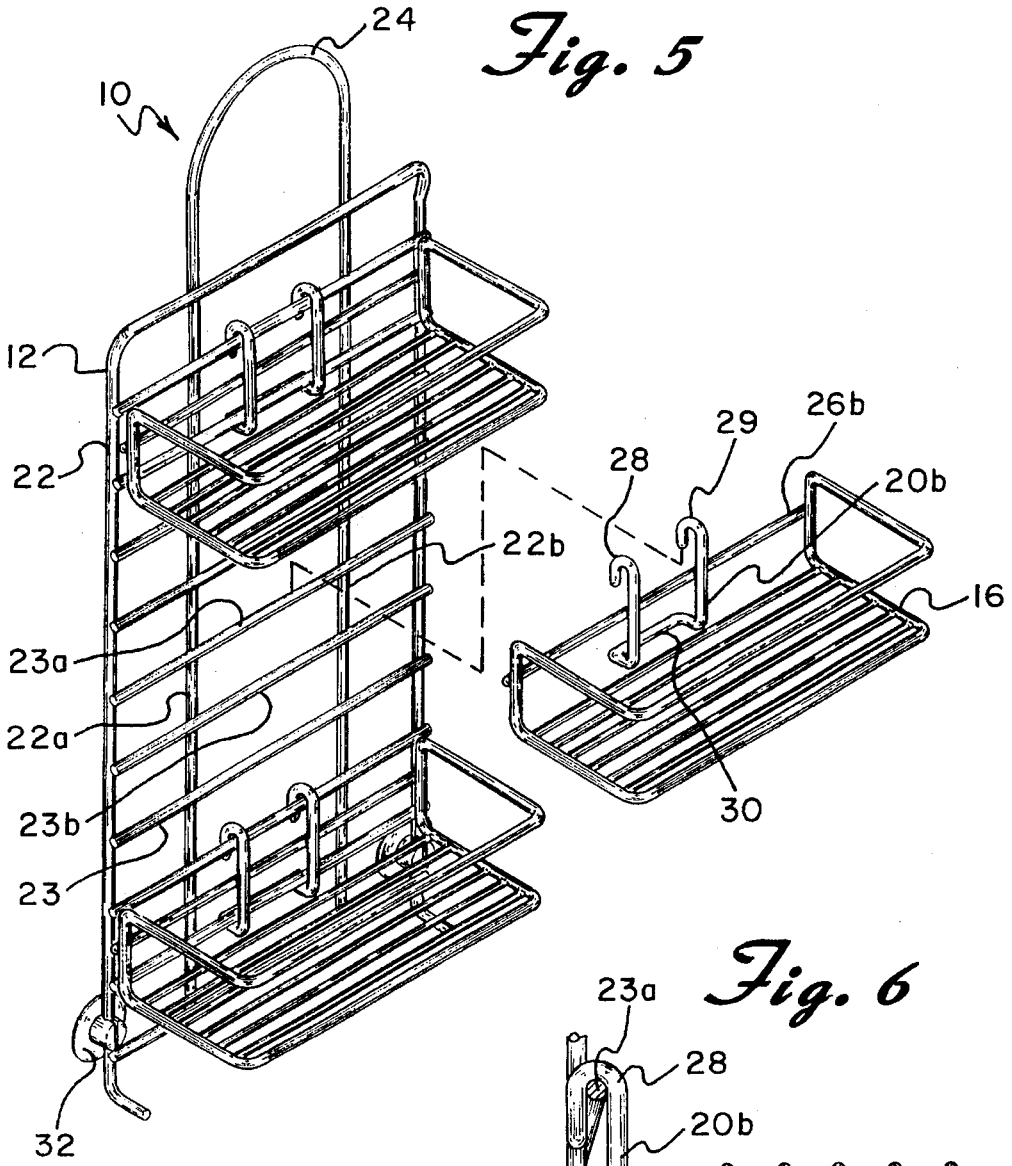
FIG. 5 is an exploded perspective view of the shower caddy with a shelf removed.

Brackets 20*a*, 20*b* and 20*c* are connected to back edges 26*a*, 26*b* and 26*c* of shelves 14, 16 and 18. The brackets 20*a*, 20*b* and 20*c* are substantially identical to one another. Accordingly, only one of the brackets will be described in detail, it being understood that the description applies equally to the other brackets. Bracket 20*b* is comprised of an upper connecting means and a lower connecting means. In the preferred embodiment, the upper connecting means is comprised of a pair of spaced apart hooks 28 and 29 extending upwardly, rearwardly and then downwardly from the shelf as shown in FIG. 5. The lower connecting means is comprised of a horizontal support 30 extending downwardly and rearwardly from the shelf between the lower ends of hooks 28 and 29.

Figure 6:
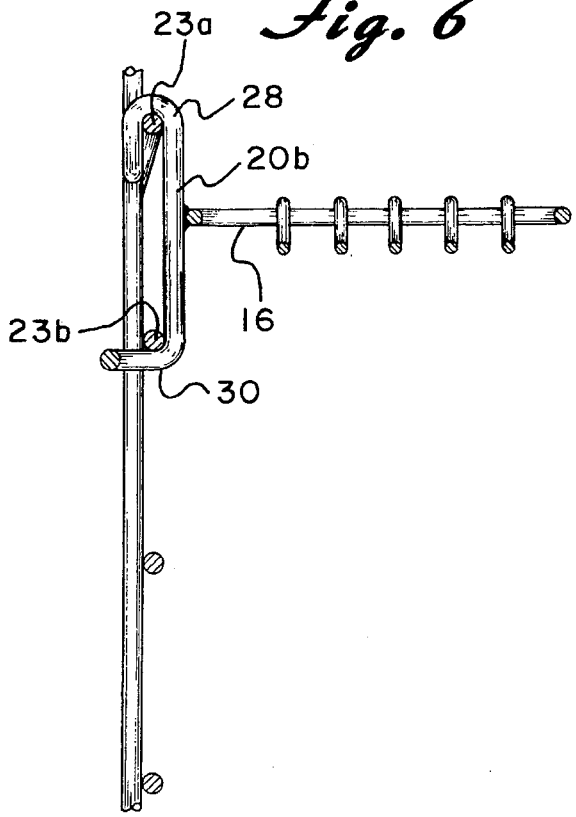
FIG. 6 is a partial, cross sectional view of a shelf and attached bracket mounted to the frame and taken along line 6—6 of FIG. 1.

As shown most clearly in FIGS. 5 and 6, hooks 28 and 29 are engagable with the horizontal bar 23*a* positioned immediately above the shelf. The lateral spacing between the pair of hooks 28 and 29 of bracket 20*b* is less than the lateral spacing between vertical bars 22*a* and 22*b* as shown in FIGS. 1 and 5. Horizontal support 30 is engagable with the horizontal bar 23*b* positioned immediately below the shelf (FIG. 6). The height of bracket 20*b* is slightly less than the space between two adjacent horizontal bars. Therefore, the horizontal support 30 is positioned under the horizontal bar 23*b* by forcing the horizontal bar slightly upwardly. The plastic coating on the horizontal bar 23*b* creates a friction fit between the horizontal support 30 and the horizontal bar 23*b*. This ensures that the bracket 20*b* can be securely connected to the frame 12.

Securing means 32 attached to the bottom of the frame 12 secures shower caddy 10 to a wall. In a preferred embodiment, securing means 32 may be a pair of suction cups. However, this is by way of example only as a variety of different securing means 32, such as a clip with an adhesive back, could also be utilized.

Figure 7:
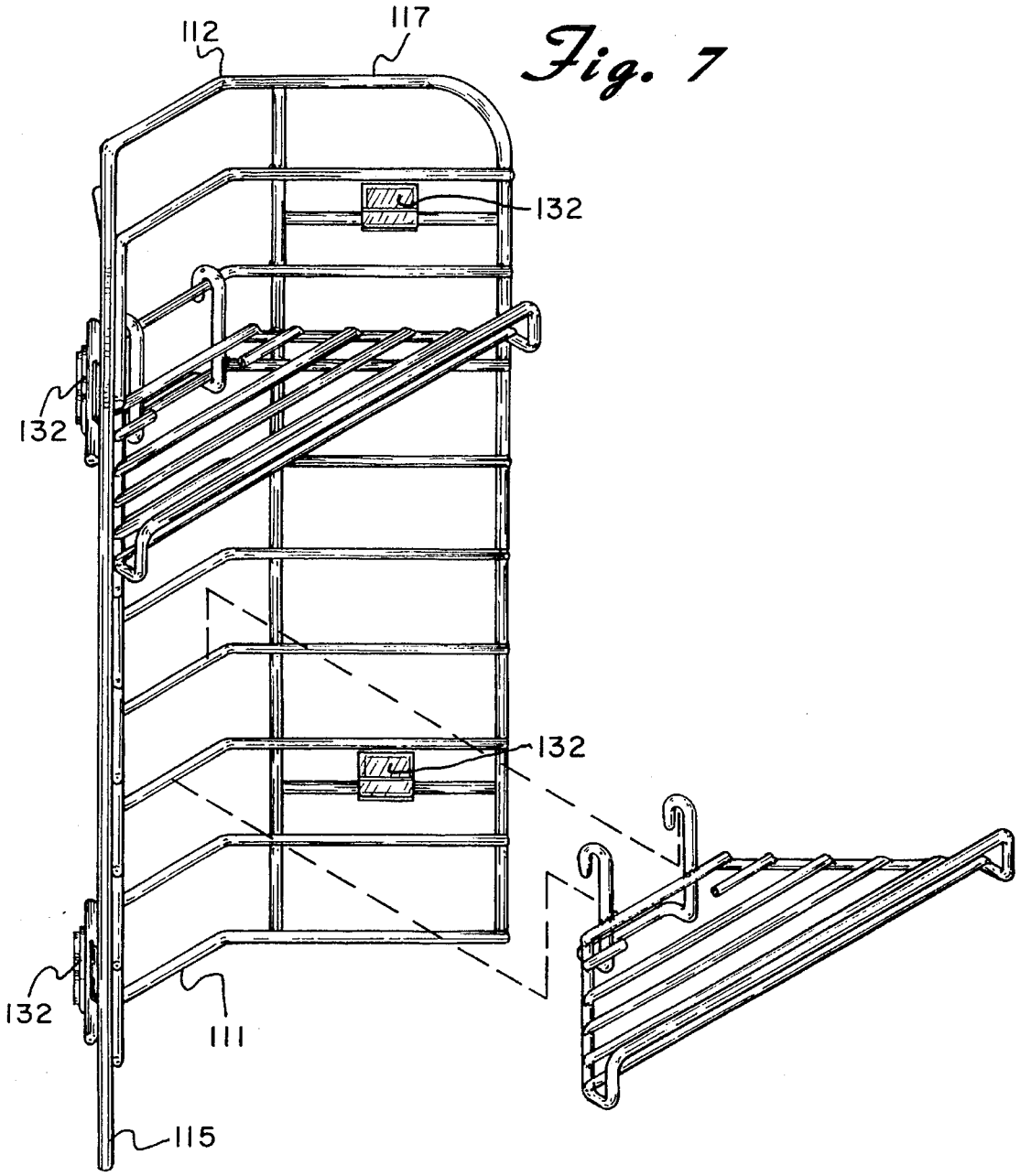
FIG. 7 is a left, front perspective view of an alternate embodiment of the invention.
Figure 8:
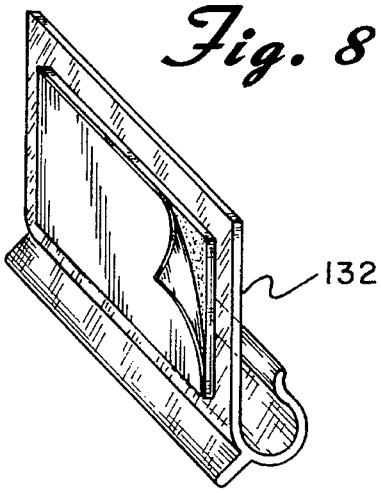
FIG. 8 is a right, rear perspective view of an adhesive clip useful with the invention.

FIG. 7 shows an alternate frame 112 having a rear wall 111. Right side wall 115 extends at an angle of 45 degrees from the right side of rear wall 111 of frame 112 and left side wall 117 extends at an angle of 45 degrees from the left side of rear wall 111. The right and left side walls 115 and 117 diverge from one another as they extend forwardly to form a right angle therebetween. The shower caddy shown in FIG. 7 can be secured in a corner of a shower wall. Adhesive clips 132, which are, per se, well known, can be used to support the frame 112 on the wall.

To facilitate an understanding of the principles associated with the foregoing apparatus, its operation will now be briefly described. The U-shaped segment 24 is placed around a shower head (not shown). The securing means 32 secures the frame 12 to the bathroom wall. Each shelf is then mounted on the frame and secured in place. This is accomplished by placing hooks 28 and 29 over the horizontal bar 23*a* located above the back edge 26*b* of the shelf 16*b* and then securing horizontal support 30 to the horizontal bar 23*b* located below the back edge 26*b* in the manner stated above. The plastic coatings on the horizontal bar 23*b* and on the support 30 causes a friction fit between the horizontal bar and the horizontal support 30. Shower items, such as soap, shampoo bottles and razors, can then be supported on the shelves.

When a relatively large bottle (not shown) is placed on shelf 16, the bottle may not be able to stand upright because the distance between shelf 16 and shelf 18 is less than the height of the bottle. In order to accommodate the larger bottle, shelf 16 has to be offset. Shelf 16 is offset by removing shelf 16 from frame 12 by pulling horizontal support 30 away from the horizontal bar 23*b* and lifting the shelf upwardly so that the hooks 28 and 29 are disengaged from the free. The shelf 16 is then offset by moving the frame to the left or to the right the requisite amount and then reattaching the same to the frame 12. This allows part of the bottle located on shelf 18 to extend upwardly passed shelf 16 without interference.

The present invention may be embodied in other specific forms without departing from the spirit or essential attributes thereof and accordingly reference should be made the appended claims rather that to the foregoing specification as indicating the scope of the invention.

I claim:

1. An adjustable shelving system comprising:

a frame having a plurality of spaced apart vertical bars and a plurality of spaced apart horizontal bars extending across said vertical bars;

a shelf having a front and a back;

an upper connecting means connected to and extending rearwardly from said back of said shelf, said upper connecting means being engagable with one of said horizontal bars located behind said back of said shelf;

a lower connecting means extending downwardly from said upper connecting means, said lower connecting means extending rearwardly beneath and being engagable with one of said horizontal bars located below the horizontal bar to which said upper connecting means is engaged, and said lower connecting means being comprised of a pair of members that extend downwardly and rearwardly from said upper connecting means, each of said downwardly and rearwardly extending members including a lower end, said lower connecting means further including a horizontal support member extending between said lower ends of said downwardly and rearwardly extending members, said horizontal support member being situated behind said one of said horizontal bars.

2. The shelving system of claim 1 wherein said upper connecting means is comprised of a pair of spaced apart hooks.

3. The shelving system of claim 1 further comprising securing means attached to the bottom of said frame for securing said shelving system to a wall.

4. The shelving system of claim 3 wherein said securing means is comprised of a pair of suction cups.

5. The shelving system of claim 4 wherein the lateral spacing between each of said hooks of said bracket is less than the lateral spacing between an adjacent pair of said vertical bar members.

6. The shelving system of claim 1 further comprising a U-shaped segment extending from the top of said frame.

7. An adjustable shelving system comprising:

a frame having a rear wall, a right side wall extending forwardly from the right side of said rear wall, a left side wall extending forwardly from the left side of said rear wall, and a plurality of spaced apart vertical bars and a plurality of spaced apart horizontal bars extending across said vertical bars;

a shelf having a front and a back;

an upper connecting means connected to and extending rearwardly from said back of said shelf, said upper connecting means being engagable with one of said horizontal bars located behind said back of said shelf, and a lower connecting means extending downwardly from said upper connecting means, said lower connecting means extending rearwardly beneath and being engagable with one of said horizontal bars located below the horizontal bar to which said upper connecting means is engaged, and said lower connecting means being comprised of a pair of members that extend downwardly and rearwardly from said upper connecting means and including a horizontal support member, each of said downwardly and rearwardly extending members including a lower end, said horizontal member extending between said lower ends of said downwardly and rearwardly extending members, said horizontal support member being situated behind said one of said horizontal bars.

8. The shelving system of claim 7 wherein said lower connecting means is comprised of a horizontal support.

9. The shelving system of claim 7 further comprising securing means attached to the bottom of said frame for securing said shelving system to a wall.

10. The shelving system of claim 7 wherein the lateral spacing between each of said hooks of said bracket is less than the lateral spacing between an adjacent pair of said vertical bar members.

11. The shelving system of claim 7 wherein said right side wall extends at a substantially 45 degree angle from the right side of said rear wall and said left side wall extends at a substantially 45 degree angle from the left side of said rear wall.

12. The shelving system of claim 1 wherein said frame and said shelf are comprised of plastic-coated metal wire and wherein at least a portion of said lower connecting means frictionally engages the undersurface of said one of said horizontal bars with which it is engagable.

13. The shelving system of claim 7 wherein said frame and said shelf are comprised of plastic-coated metal wire and wherein at least a portion of said lower connecting means frictionally engages the undersurface of said one of said horizontal bars with which it is engagable.

* * * * *